US010004310B2

(12) United States Patent
Wilson

(10) Patent No.: US 10,004,310 B2
(45) Date of Patent: Jun. 26, 2018

(54) WHEELED SUITCASE COMPRISING A RETRACTABLE ROD

(71) Applicant: Louis Vuitton Malletier, Paris (FR)

(72) Inventor: Donald John Wilson, Paris (FR)

(73) Assignee: LOUIS VUITTON MALLETIER, Paris (FR)

( * ) Notice: Subject to any disclaimer, the term of this patent is extended or adjusted under 35 U.S.C. 154(b) by 0 days. days.

(21) Appl. No.: 15/028,818

(22) PCT Filed: Oct. 22, 2014

(86) PCT No.: PCT/FR2014/052694
§ 371 (c)(1),
(2) Date: Apr. 12, 2016

(87) PCT Pub. No.: WO2015/059414
PCT Pub. Date: Apr. 30, 2015

(65) Prior Publication Data

US 2016/0255933 A1 Sep. 8, 2016

(30) Foreign Application Priority Data

Oct. 25, 2013 (FR) ..... 13 60454

(51) Int. Cl.

| | |
|---|---|
| ***A45C 13/30*** | (2006.01) |
| ***A45C 13/26*** | (2006.01) |
| ***A45C 5/03*** | (2006.01) |
| ***A45C 5/14*** | (2006.01) |

(52) U.S. Cl.
CPC ..... *A45C 13/262* (2013.01); *A45C 5/03* (2013.01); *A45C 5/14* (2013.01); *A45C 2013/267* (2013.01)

(58) Field of Classification Search
CPC . A45C 13/262; A45C 2013/267; A45C 13/30; A45C 2013/303
USPC ..... 242/243; 150/108
See application file for complete search history.

(56) References Cited

U.S. PATENT DOCUMENTS 1,979,978 A * 11/1934 Martin ..... A45C 13/26 190/115
3,982,613 A * 9/1976 Wood ..... A45C 13/262 190/116
4,508,202 A * 4/1985 Siegert ..... A45C 13/262 16/113.1
5,027,874 A * 7/1991 Gazzola ..... A45F 3/02 150/107

(Continued)

FOREIGN PATENT DOCUMENTS

| | | | |
|---|---|---|---|
| EP | 2366304 | A1 | 9/2011 |
| GB | 2297967 | A | 8/1996 |
| WO | WO-95/19721 | A1 | 7/1995 |

OTHER PUBLICATIONS

International Search Report Application No. PCT/FR2014/052694; dated Mar. 25, 2015.

*Primary Examiner* — Sue A Weaver
(74) *Attorney, Agent, or Firm* — Miller, Matthias & Hull LLP

(57) ABSTRACT

The invention relates to a wheeled suitcase comprising a suitcase body mounted on wheels and a rod comprising at least one flexible strip element connected to a handle. The flexible strip element can be wound onto itself in order to retract the handle, and can be unwound forming a tube in order to deploy the handle.

12 Claims, 5 Drawing Sheets

(56) References Cited

U.S. PATENT DOCUMENTS

| | | | | |
|---|---|---|---|---|
| 5,294,029 | A * | 3/1994 | Shimura | A45C 5/00 150/108 |
| 5,555,960 | A * | 9/1996 | Bartsch | A45C 13/262 190/115 |
| 5,897,039 | A * | 4/1999 | Swenke | A45C 13/26 150/108 |
| 6,256,938 | B1 * | 7/2001 | Daton-Lovett | F16H 19/064 138/119 |
| 8,123,092 | B2 * | 2/2012 | Krulik | A45C 13/30 150/108 |
| 2013/0068579 | A1 * | 3/2013 | Mathieu | A45C 13/262 190/115 |

* cited by examiner

WHEELED SUITCASE COMPRISING A RETRACTABLE ROD

CROSS-REFERENCE TO RELATED APPLICATION

This Application is a 35 USC § 371 U.S. National Stage thing of International Application No. PCT/FR2014/052694 filed on Oct. 22, 2014,and claims priority under the Paris Convention. to French Patent Application No. 13 60454 filed on Oct. 25, 2013.

FIELD OF THE DISCLOSURE

The present invention relates to a wheeled suitcase comprising a suitcase body mounted on wheels and a rod connected to a handle, the rod being mounted on the body so as to be movable between an extended position enabling a user to maneuver the suitcase (for example pulling it in the case of a suitcase with two wheels, or pushing it in the case of a suitcase with four wheels) and a retracted position inside the body.

BACKGROUND OF THE DISCLOSURE

Usually, the movable rod is implemented in the form of at least one rigid tube slidably mounted in a guide which is integral with the body of the suitcase. For example, FR 2,870,693 describes such an embodiment.

The guide or guides receiving the tube or tubes are positioned in or on the suitcase.

When positioned inside the suitcase, such an assembly represents a certain volume that is lost to the user of the suitcase.

Furthermore, whether the assembly is positioned inside or outside the suitcase, it increases the mass of the suitcase, which may be a disadvantage for the user who has to tow the suitcase and who must comply with suitcase weight limits imposed by airline companies.

SUMMARY OF THE DISCLOSURE

The invention aims to overcome some or all of the aforementioned disadvantages.

To this end, the invention provides a suitcase as mentioned above. Which is characterized in that the rod comprises, at least one stretchable and flexible strip element, the strip element being configurable between:

- a wound state, corresponding to the retracted position of the rod, wherein the strip element is wound around a first axis, and
- an unwound state, corresponding to the extended position of the rod, wherein the strip element extends substantially along a second axis substantially perpendicular to the first axis, the strip element at least partially forming a tube around said second axis in the unwound state.

Thus, the slidably mounted rigid tube is replaced by a flexible strip which occupies little space in the wound state and which may possibly be lighter than the sliding tubes of the prior art.

In accordance with several embodiments which will be described below, the suitcase according to the invention may comprise the following characteristics, taken separately or in combination:

- the handle may comprise a connection part, extending at least partially along the second axis, around which one end of the strip element can be wrapped;

- the connection part may comprise a cylindrical portion;
- the strip element may extend between first and second ends, the first end able to be wound onto a rotating support mounted so as to pivot within the suitcase body about the first axis, and the second end able to wrap around the second axis and be secured near the handle;
- the rotating support may foe made to rotate by an actuator;
- it may be equipped with a locking device suitable for selectively locking the rod in the extended position (at the desired length with or without position distinction);
- the actuator may comprise a spring resiliently urging the rotating support in a direction that allows the strip to wind around said rotating support;
- or, in a variant embodiment, the actuator may comprise an electric motor;
- the retractable rod may comprise one or more retractable sections, and in particular two retractable sections;
- the stretchabie element may comprise fibers of carbon (and/or aramid or any other material capable of providing the expected performance). In this manner, the stretchabie element has the distinctive feature of resisting twisting, bending, and/or stretching stresses, which makes it very advantageous in its application to rolling suitcases;
- the suitcase body may comprise a housing which accommodates the strip element in its wound state and which has a through-opening through which said strip element exits the housing and the suitcase body;
- finally, as part of a particularly advantageous embodiment (because simple to implement and therefore inexpensive), the housing may have a size which is adjusted to the volume occupied by the strip element in the wound state, and the strip element may be connected to a stop member.

BRIEF DESCRIPTION OF DRAWINGS

Other features and advantages of the invention will be apparent from the following description of several embodiments, given by way of non-limiting examples, with the accompanying drawings.

In the drawings.

DETAILED DESCRIPTION OF THE DISCLOSURE

The figures described below show two variant embodiments of a suitcase according to the invention and two variants of a mechanism which can be implemented inside each suitcase.

Another variant will be presented further below, this other variant having no mechanism.

In the various figures, the same references designate identical or similar elements.

Figure 1:
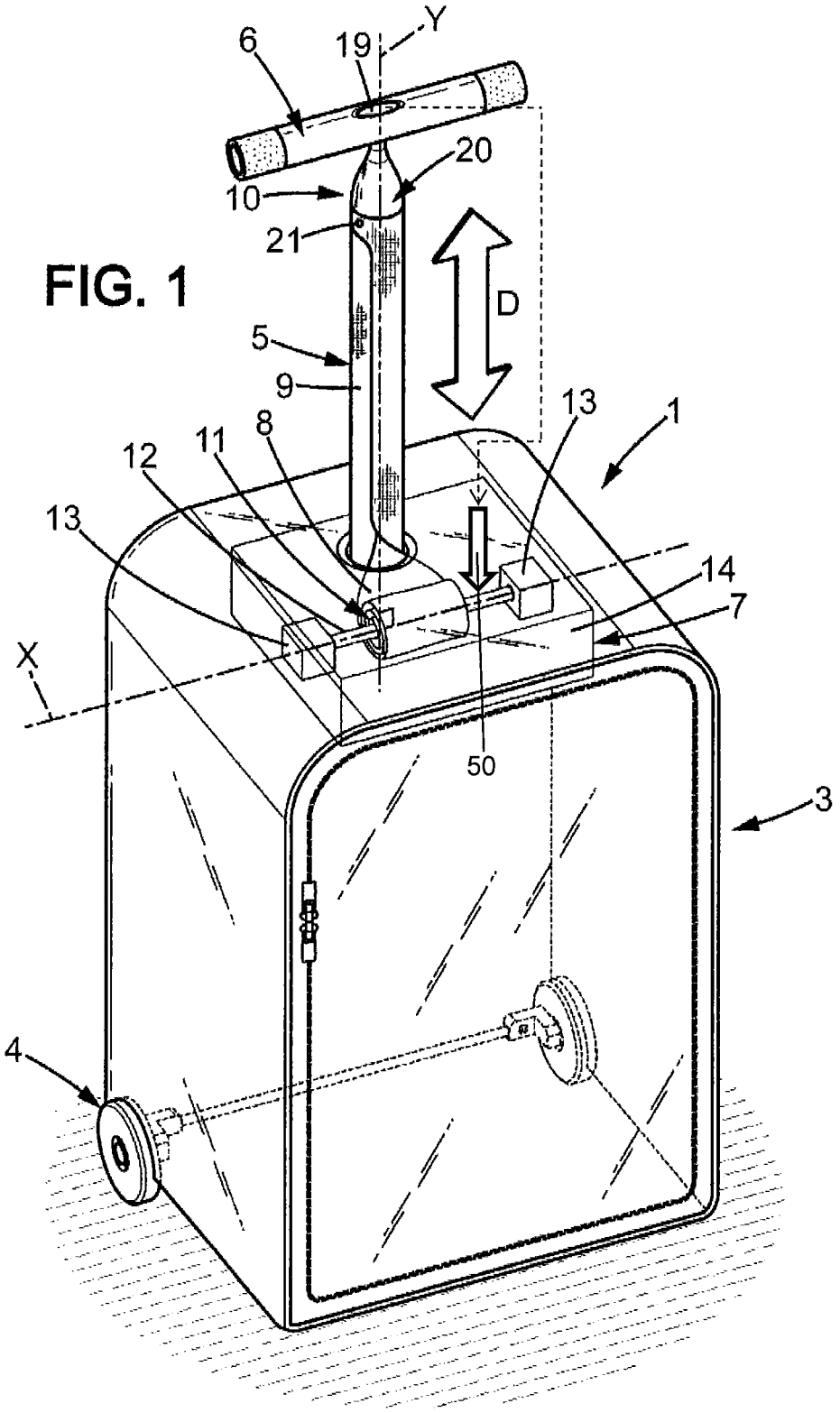
FIG. 1 shows a first suitcase of the invention, in a perspective view.

The suitcase 1 shown in FIG. 1 is of the rolling type and comprises a suitcase body 3 mounted on wheels 4 equipped with a rod 5 connected to a handle 6 which allows a user to pull the suitcase as it rolls on the ground.

Figure 2:
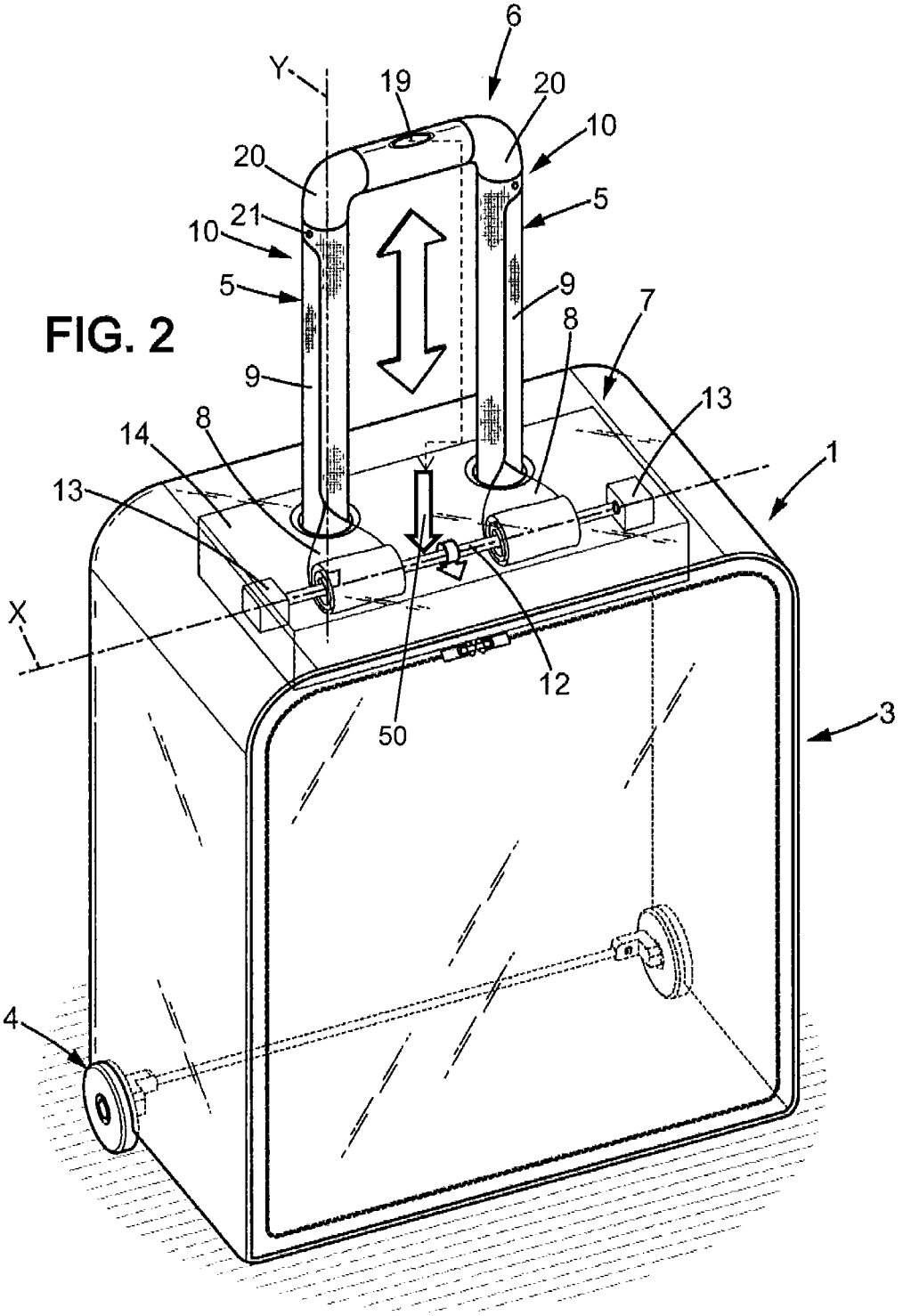
FIG. 2 shows a second suitcase of the invention, in a perspective view.

The rod 5 is mounted on the body 3 of the suitcase 1 so as to be movable between an extended position (which is illustrated in FIGS. 1 and 2) and a retracted position (not shown) where the handle 6 is positioned against a sidewall 7 of the suitcase, said sidewall 7 being an upper portion of the suitcase when the suitcase is standing on its wheels 4.

Figure 5:
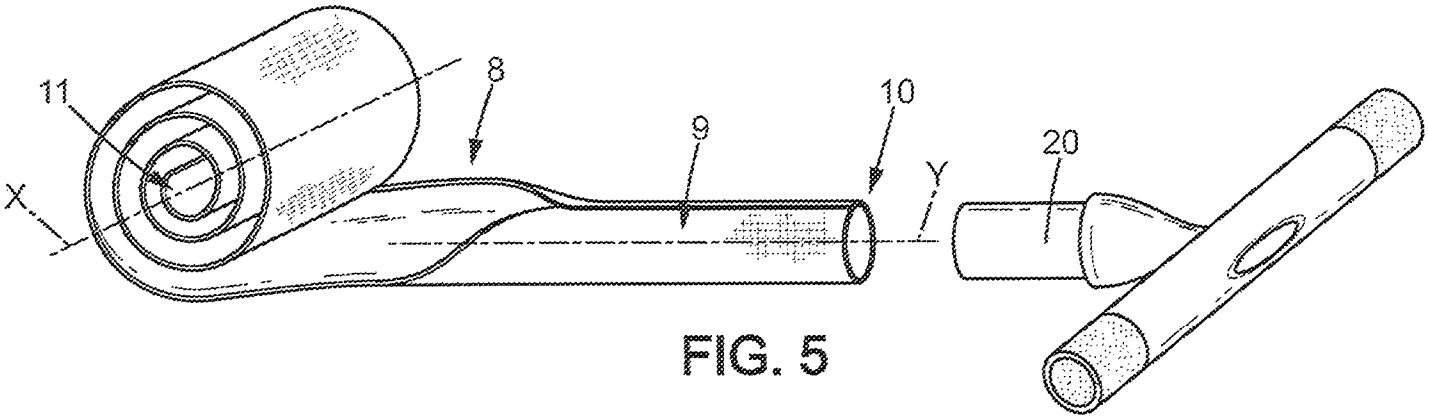
FIG. 5 shows a partially wound (or rolled) strip used in a suitcase of the invention, the strip being seen in a perspective view.

In FIG. 1, the rod 5 comprises, in accordance with the invention, a strip element 8 which is more particularly illustrated in FIG. 5.

Or the rod 5 may comprise several strip elements 8, and in particular two strip elements 8, forming two sections, as illustrated by the embodiment of FIG. 2.

The strip element 8 is a stretchabie and flexible strip, which may be for example approximately 60 cm long, which is configurable between two states: a wound state shown in FIG. 5 (which corresponds to the retracted position of the rod) and an unwound state which corresponds to the extended position of the rod shown in FIGS. 1 and 2.

To achieve this, the strip element 8 may consist of a strip made of a material comprising fibers of carbon or aramid or any other materials able to provide the appropriate mechanical and lightness characteristics, which is a material sufficiently flexible to be wound about a first axis X and which allows the strip, when extended, to wrap onto itself automatically (by shape memory) about a second axis Y perpendicular to the X axis so as to form a hollow tube 9. Such a strip element 8 is for example described in document U.S. Pat. No. 6,256,938, the content of which is incorporated herein by reference.

The hollow tube 9 is sufficiently rigid to withstand the tensile forces generated when a user causes the suitcase to roll (in particular in the case of a suitcase with two wheels).

The hollow tube 9 is also sufficiently rigid not to bend or flex when the rod is in the extended and vertical position and when a user causes the suitcase to roll (in particular in the case of a suitcase with four wheels).

The strip element 8 is mounted on the suitcase as follows:

As can be seen in FIG. 5, the strip element 8 extends between an upper first end 10 connected to the handle 6 and a lower second end 11.

According to the embodiment which is illustrated in FIGS. 1 and 2, the second end 11 winds onto and is secured to a rotating support 12 rotating about axis X, for example a pin extending longitudinally along axis X.

It should be understood that this embodiment is not limiting for the invention. Another embodiment will foe described below, in which the strip is not connected to a rotating support 12.

In FIG. 1 for example, one will note that the rotating support 12 is mounted on bearings 13 fixed to the body 3 of the suitcase, preferably inside the suitcase. The bearings 13, the rotating support 12, and the second end of the strip element 8, may be contained in a housing 14, itself fixed inside or on the suitcase 1.

For aesthetic reasons, the housing 14 is fixed, inside the body 3 of the suitcase 1.

Thus, the rotating support consisting in particular of the freely rotating pin 12 is mounted inside the body 3 the suitcase 1.

Figure 3:
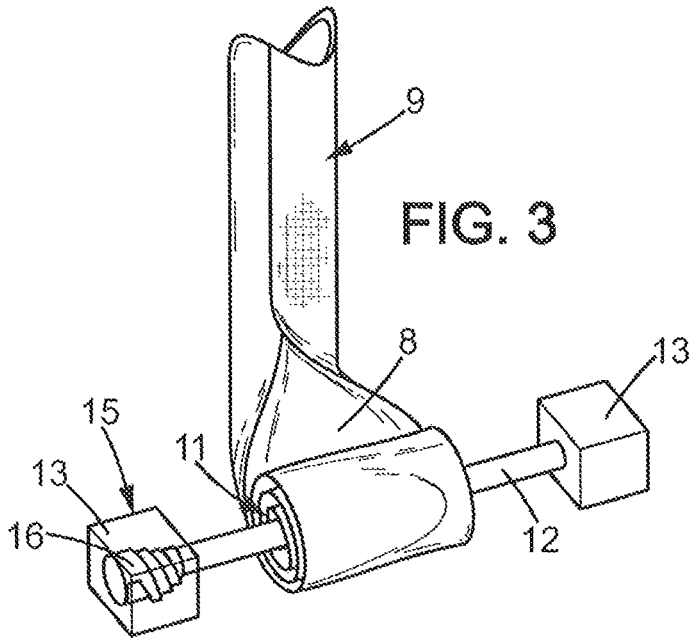
FIG. 3 shows a first exemplary mechanism contained in a suitcase of the invention, the mechanism being seen in a perspective view.
Figure 4:
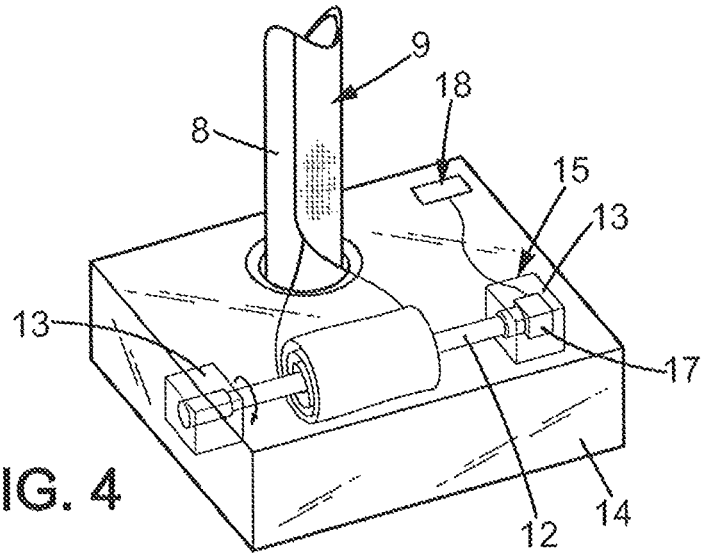
FIG. 4 shows an alternative mechanism which can be contained in a suitcase of the invention, the mechanism also being seen in a perspective view.

The rotation of the pin 12 about its axis X may be controlled by an actuator 15, of which two embodiments are schematically illustrated in FIGS. 3 and 4.

FIG. 3 shows that one of the supports 13 comprises a volute spring 16. The volute spring 16 is a spring which resiliently biases the rotating support (or pin) 12 in a direction that winds the strip element 8 the pin 12.

In this embodiment, the strip element 8 is forced into the wound state. This means that, when a user is not pulling on the handle 6, the rod 5 returns naturally to the retracted position within the body 3 of the suitcase 1.

To maintain the rod 5 in the extended position, a button 19 is provided in the handle 6, which controls a locking device 50 which controls locking the rotation of the pin 12.

Another actuator 15 may also be implemented: in FIG. 4, one of the supports 13 comprises a small motor 17, on the order of one to several centimeters in size.

Operation of the motor 17 can be controlled by the user via a button 18.

The winding mechanism of the strip element 8 is situated at the end 11 of the strip element 8 just described; reference will now be made to the elements located at the other end 10 of the strip element 8.

End 10 is attached to the handle 6 of the suitcase 1.

More specifically, the substantially T-shaped handle 6 of the suitcase 1 is fitted with a connection part 20 that is cylindrical in shape (see FIGS. 1 and 5).

The connection part 20 is formed by a hollow cylindrical sleeve of which one end is secured to the T-shaped handle 6. The other end of the connection part 20 free. The strip element 8, tubular in shape, is wrapped around the connection part 20. The axis of the connection part 20 is thus coincident with the axis Y around which the strip element 8 wraps.

The strip element 8 is fixed to the connection part by any known means, for example by means of a rivet 21.

Alternatively, the suitcase 1 may be as shown in FIG. 2, which is similar to the suitcase 1 of FIG. 1 but has a different handle 6 than that of suitcase 1.

The handle 6 of the suitcase of FIG. 2 is mounted at the end of two parallel rods 5. It may comprise, at each of its ends, an elbow-shaped connection part 20 with a substantially cylindrical free end.

We will now refer to a first mode of operation of the suitcase just described and comprising a mechanism for retraction of the rod.

To do this, we will refer to the suitcase shown in FIG. 1 or 2, in which the mechanism for retracting the rod 5 comprises a pin 12 rotatably mounted in supports 13 which is biased by a volute spring 16.

Initially, the suitcase 1 has a rod 5 in the retracted position: this means that the handle 6 of the suitcase lies against the sidewall 7 of the suitcase.

To move the suitcase, the user pulls on the handle 6 in a vertical direction D shown in FIG. 1.

This action causes the strip element 8 to unwind from around the pin 12, and to progressively wrap around the Y axis as the strip element 8 exits the housing 14.

Once out of the housing 14, the strip element 8 forms a tube 9.

It the user wishes to maintain the rod 5 in the extended position, he or she can press the button 19. This is particularly useful for a suitcase with four wheels, where the force applied to the rod to move the suitcase is not a longitudinal tractive force.

Or the user may choose not to activate the button 19 and to allow the suitcase to roll: by pulling on the handle, this creates an inverse force greater than the force generated by the volute spring 16, so that the rod 5 not retract into the body 3 of the suitcase 1. This embodiment is particularly suitable for two-wheeled suitcases towed by the user.

When the user wants to immobilize, the suitcase 1, he or she stops pulling on the handle 6. The force of the volute spring 16 then rotates the pin 12 which winds the strip element 8 onto it.

The rod 5 is thus retracted and the handle returns to its initial position against the sidewall 7.

If the user has previously actuated the button 19 lock the rod 5 in the extended position, he or she can unlock the rod 5 by pressing the button 19 again.

Another embodiment may be provided, as indicated above, with no mechanism for ensuring the retraction (automatic or otherwise) of the rod, the rod then remaining in the position in which it is placed.

Figure 6:
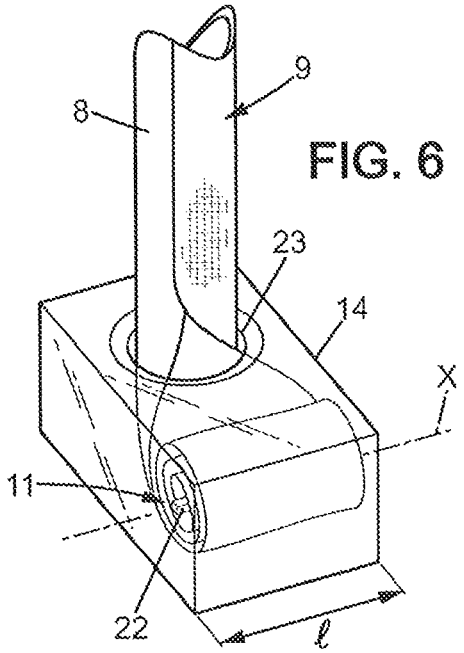
FIG. 6 shows a housing contained in a suitcase of the invention according to another embodiment, with an element in the wound state, the housing and the element being seen in a perspective view.
Figure 7:
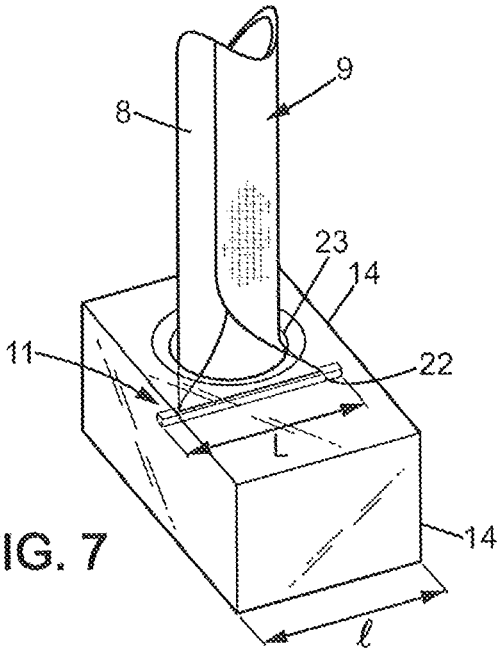
FIG. 7 shows the housing and the element of FIG. 6, seen in a perspective view, the element being shown in the unwound state.

For example, as shown in FIGS. 6 and 7, the housing 14 may have a size which is adjusted to the volume occupied by the strip element 8 in its wound state (see FIG. 6).

This is possible due to the rigidity of the strip element 8 which, in its unwound state, forms a self-supporting rigid tube 9 which remains in its extended position.

The user must exert force on the handle 6 to force the strip element 8 to retract into the housing 14 and wind around the X axis.

FIG. 6 shows that the width 1 of the housing is substantially greater than the width of the strip element 8, so that when the strip element 8 is forcibly inserted into the housing 14, it does not rub against the inner walls of the housing 14.

The width 1 is, however, sufficiently close to the width of the strip element 8 that the housing 14 forces a roll to be formed when the strip element 8 is forced back into the housing 14.

As can be seen in FIGS. 6 and 1, the strip element 8 comprises, at its end 11, a rod 22 which extends for the entire width of the strip element 8 and protrudes to each side of the strip element. Rod 22 has a length L substantially greater than the width l of the housing 14.

Rod 22 forms a stop which is positioned against the through-opening 23 of the housing 14 when the strip element 8 has fully unwound. End 11 of the strip element 8 thus retained inside the housing 14.

The invention claimed is:

1. A wheeled suitcase, comprising:

a suitcase body mounted on wheels;

a rod connected to a handle, the rod being mounted on the suitcase body so as to be movable between an extended position enabling a user to maneuver the wheeled suitcase and a retracted position inside the suitcase body, wherein said rod comprises at least one flexible strip element, the flexible strip element being configurable between:

a wound state, corresponding to the retracted position of the rod, wherein the flexible strip element is wound around a first axis, and an unwound state, corresponding to the extended position of the rod, wherein the flexible strip element extends substantially along a second axis substantially perpendicular to the first axis, the flexible strip element being at least partially wrapped around said second axis so as to at least partially forming a tube around said second axis in the unwound state.

2. The wheeled suitcase according to claim 1, wherein the handle comprises a connection part extending at least partially along the second axis, and one end of the flexible strip element is wound around said connection part.

3. The wheeled suitcase according to claim 2, wherein the connection part comprises a cylindrical portion.

4. The wheeled suitcase according to claim 1, wherein the flexible strip element extends between first and second ends, the first end being wound onto a rotating support mounted so as to pivot within the suitcase body about the first axis, the second end being wrapped around the second axis and secured near the handle.

5. The wheeled suitcase according to claim 4, wherein the rotating support can be made to rotate by an actuator.

6. The wheeled suitcase according to claim 5, comprising a locking device suitable for selectively locking the rod in the extended position.

7. The wheeled suitcase according to claim 5, wherein the actuator comprises a spring resiliently urging the rotating support in a direction that allows the flexible strip element to wind around said rotating support.

8. The wheeled suitcase according to claim 5, wherein the actuator comprises an electric motor.

9. The wheeled suitcase according to claim 1, wherein said rod comprises two retractable sections.

10. The wheeled suitcase according to claim 1, wherein said at least one flexible strip element comprises fibers of carbon or aramid or any other material capable of providing the mechanical and lightness characteristics.

11. The wheeled suitcase according to claim 1, wherein said suitcase body comprises a housing which accommodates said flexible strip element in said wound state and which has a through-opening through which said flexible strip element exits the housing and the suitcase body.

12. The wheeled suitcase according to claim 11, wherein said housing has a size which is adjusted to the volume occupied by said flexible strip element in the wound state, and wherein the flexible strip element is connected to a stop member.

* * * * *